United States Patent [19]

Stemmler et al.

[11] Patent Number: 4,648,503

[45] Date of Patent: Mar. 10, 1987

[54] ARTICLE TURNING DEVICE

[75] Inventors: Kurt Stemmler, Neuwied; Martin Blumle, Horhausen, both of Fed. Rep. of Germany

[73] Assignee: Winkler+Dunnebier Maschinenfabrik und Eisengiesserei GmbH & Co. KG, Neuwied, Fed. Rep. of Germany

[21] Appl. No.: 691,279

[22] Filed: Jan. 14, 1985

[30] Foreign Application Priority Data

Jan. 18, 1984 [DE] Fed. Rep. of Germany ..... 3401511

[51] Int. Cl.[4] ..... B05G 47/24

[52] U.S. Cl. ..... 198/410; 198/412; 198/471.1; 198/608; 271/185

[58] Field of Search ..... 198/410, 412, 411, 644, 198/413, 414, 471.1, 689.1, 468.4, 380, 403, 377, 378, 608; 271/184, 185, 194, 196, 225, 276

[56] References Cited

U.S. PATENT DOCUMENTS

| | | | |
|---|---|---|---|
| 2,509,725 | 5/1950 | Dalton | 198/412 X |
| 2,752,154 | 6/1956 | Nelson | 271/196 |
| 3,080,956 | 3/1963 | Salzmann | 198/412 X |
| 3,587,824 | 6/1971 | Rochla | 198/377 |
| 3,721,340 | 3/1973 | Kruse et al. | 198/689.1 X |
| 3,847,273 | 11/1974 | Buhayar | 198/413 X |
| 4,085,839 | 4/1978 | Crawford | 198/411 X |

FOREIGN PATENT DOCUMENTS

| | | | |
|---|---|---|---|
| 1109093 | 6/1961 | Fed. Rep. of Germany | 198/403 |

OTHER PUBLICATIONS

"Automatic Wafer Transfer & Turnover Tool", *Western Electric Technical Digest,* No. 49, p. 1, Jan. 1978, Abraham et al.

*Primary Examiner*—Joseph E. Valenza
*Assistant Examiner*—Jonathan D. Holmes
*Attorney, Agent, or Firm*—Collard, Roe & Galgano

[57] ABSTRACT

There is provided a device and a method for turning flat articles, more particularly letter envelopes, flat bags or the like. The article is first moved out of its direction of conveyance into a curvilinear path, whereafter—without stopping in its original direction of conveyance—it is moved into a curvilinear path in a new direction until finally advancing onwards in its original direction of conveyance.

10 Claims, 4 Drawing Figures

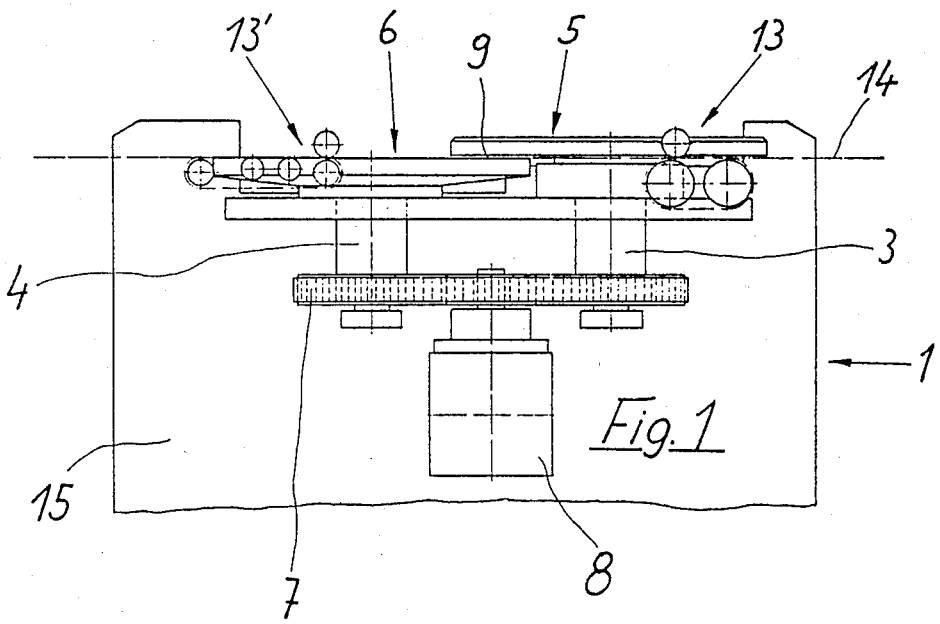
Fig. 1
Fig. 2
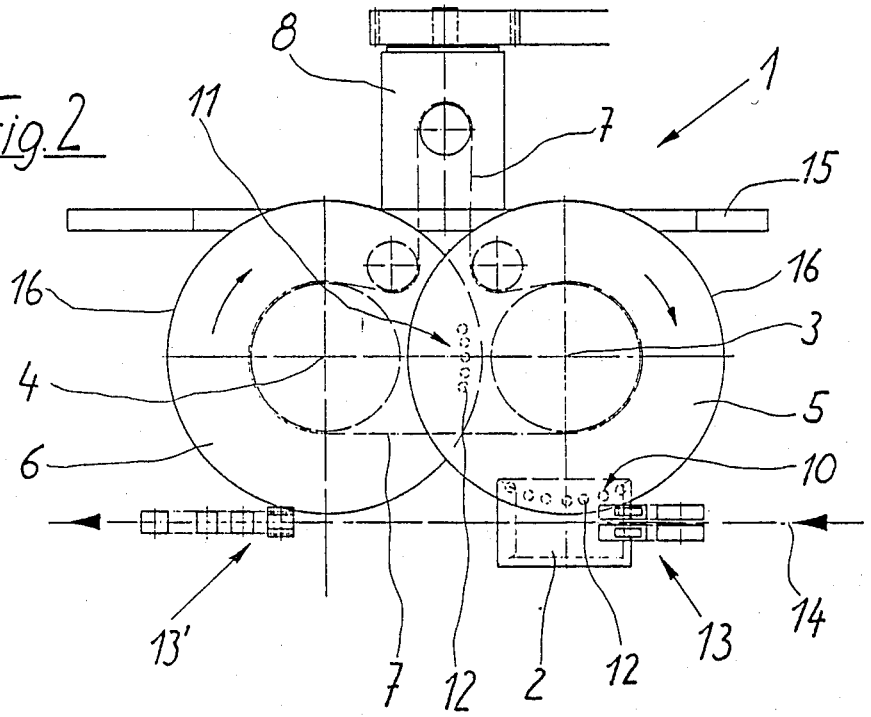

ARTICLE TURNING DEVICE

The present invention relates to a device for turning flat articles. More particularly, the present invention relates to a device for turning letter envelopes, flat bags or the like.

Devices of the type referred to have long been known. Such devices are required whenever it is necessary to pivot such flat articles through a right angle or any other angle for the sake of convenient further processing. In one very simple solution of this problem, the article first reaches a stop position and is changed over without rotation from its original direction of conveyance for onwards conveyance in a new direction, so that the article is positioned differently in the new direction of conveyance as compared with the original direction of conveyance. Despite the low engineering cost, this kind of turning has considerable disadvantages since production machines must be arranged at angles to one another and cannot be set up in a line.

It is, therefore, a primary object of the present invention to provide a turning device which enables the article to be turned while substantially retaining the original direction of conveyance.

This object is accomplished according to the present invention by the provision of two entraining members which are disposed at an offset to one another in the direction of conveyance, overlap one another to some extent, and each being provided with means for picking up and delivering the article.

The two entraining members are disposed alongside the conveying path of the article and ensure that the article first moves from its direction of conveyance into a curvilinear path, stops on such path, then moves onwards in a new direction along a second curvilinear path, finally returing to the original direction of conveyance. The angle through which the article is rotated is more or less than 90° depending upon the position of the transfer location where one entraining member delivers the article to the other entraining member.

A particular advantage of this method and of the apparatus for carrying it into practice is that the article barely leaves its original direction of conveyance. Furthermore, the device is a short compact unit which takes up little space, operates very accurately and entails reduced engineering costs.

Conveniently, according to another feature of the invention, one entraining member engages over the article and the other entraining member engages below it. The means for taking up and delivering the article are, with advantage, suction devices disposed on the entraining members, the same preferably being turntables.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views:

FIG. 1 is a schematic illustration of an end elevational view of the main components of the article turning device according to the present invention;

FIG. 2 is a plan view of the device of FIG. 1 during the transfer of an article;

Figure 3:
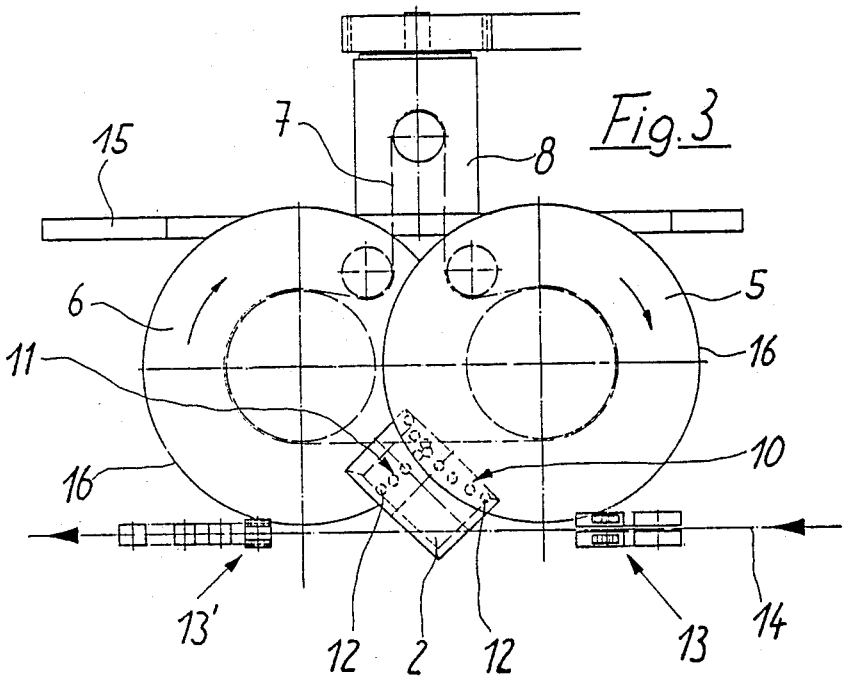
FIG. 3 is a plan view of the device as in FIG. 2 but during the delivery of the article from one entraining member to the other.

Now turning to the drawing, there is shown in FIG. 1 a turning device, generally designated 1, for turning or pivoting articles, more particularly flat articles 2 (FIG. 2), having two entraining members 5 and 6 rotatable about axes 3 and 4, respectively, disposed at an offset from one another in the direction of conveyance 14. Entraining members 5 and 6 of the embodiment illustrated are turntables but can of course be of some other form and shape.

The two turntables 5 and 6 are driven by a drive 7, which may be in the form of a belt drive, and with the interposition of gearing 8, driven at the same hand in the sense of rotation indicated by arrows in the drawings. Turntables 5 and 6 overlap one another to some extent and are disposed in different planes. As clearly seen in FIG. 1, only a narrow air gap 9 is present between the bottom of the top turntable 5 and the top of the bottom turntable 6. Turntables 5 and 6 overlap one another in the air-gap zone, in which they have an opposite sense of rotation.

In FIG. 2 is it seen that turntable 5 is provided with means 10, and turntable 6 with means 11, for transferring and delivering the article 2. The means 10 and 11 can be grippers or the like, one being disposed on the top of its respective turntable and the other being disposed on the bottom of its respective turntable. In the embodiment illustrated means 10 and 11 take the form of a suction facility comprising for each turntable a group of associated suction orifices 12. Orifices 12 communicate, by way of ducts in turntables 5 and 6 and by way of other lines (not shown), with a vacuum source and an actuating or control device and enable articles 2 to be held on to turntable 5 or 6 by suction when orifices 12 are near article 2.

Suction means 10 and 11 are disposed near one another on turntables 5 and 6 and, consequently, an article 2 can be transferred from one turntable 5 to the other turntable 6 for onwards conveyance thereby.

Turning device 1 also has various conveying and carrying rollers 13 for the flat articles 2. Rollers 13 are disposed in the direction of the conveying path of articles 2, receive the same from a machine preceding device 1 and convey the articles after turning or pivoting to a subsequent machine or facility (not shown).

The two turntables 5 and 6, their belt drive and rollers 13 are mounted in a machine frame 15, as is also apparent from the diagrammatic figures. Both turntables 5 and 6 extend over the path 14 of articles 2 so that their peripheries 16 extend beyond the articles on the path 14.

Figure 4:
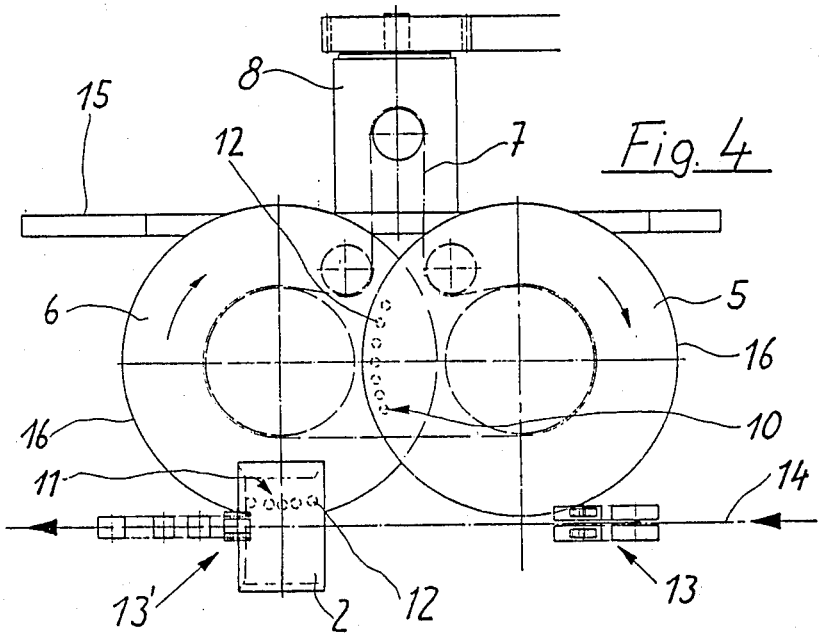
FIG. 4 is a plan view similar to FIGS. 2 and 3 during the delivery of the turned article.

To turn or pivot articles 2, turning device 1 operates as follows:

An article 2 supplied from the right in FIG. 2 by means of rollers 13 is engaged by suction means 10 of turntable 5 and is entrained in the curvilinear turning direction of the turntable. After pivoting through a few degrees the article enters the air gap between the two turntables 5 and 6. The position and arrangement of the suction orifices 12 associated with suction means 11 of turntable 6 are so chosen that, as FIG. 3 shows, the orifices 12 of turntable 6 cross the direction of movement of orifices 12 of turntable 5 when half the programmed pivoting movement, referred to the direction of path 14, has been reached. In this position, and as shown in FIG. 3, the article 2 is transferred from turntable 5 to turntable 6, to which end suction means 10 is rendered inoperative by control means (not shown) and suction means 11 of turntable 6 is made operative so that the same takes up article 2. Article 2 therefore now moves in the direction of rotation of turntable 6 until it approaches removal rollers 13'. Suction means 11 is then rendered inoperative so that turntable 6 releases article 2. This state of affairs is shown in FIG. 4. A comparison between FIG. 2 and FIG. 4 shows that the two turntables 5 and 6 have turned or pivoted article 2 through a right angle.

A different pivot angle can be provided to some extent if article 2 is transferred from turntable 5 to turntable 6 not at the location shown in FIG. 3 but earlier or later as considered in the direction of rotation.

The turntables so carry article 2 that the same projects beyond the turntable peripheries 16. Also, conveying path 14 is disposed substantially at a tangent to turntable peripheries 16.

The invention is not limited to the embodiment illustrated in the drawings but can be varied in a variety of ways without departing from the underlying idea of the invention. The main point is that the article first moves out of its direction of conveyance into a curvilinear path and there - without being completely stopped in its original direction of conveyance - moves into a curvilinear path in a new direction until finally advancing onwards in its original direction of conveyance.

The conveying and carrying means 13 and 13' can theoretically be other than the rollers 13 shown and are disposed for adjustment in the entry to and exit from the article turning device 1 in the original direction of conveyance, in conformity with the format of flat articles 2. The means 13 and 13' can be conveying and carrying rollers or belts on or between which the articles 2 are conveyed.

Conveniently, means 13 and 13' in the entry and exit respectively can take the form of stationary segmental rolls driven at the cadence of the machine.

In the embodiment shown in the drawings the rotating entraining means have as transfer facility, suction means 10 and 11 disposed near one another. The invention is not of course limited to the use of such a means on the entraining members 5 and 6, since grippers can be provided thereon which take up the arriving articles, then transfer them. The use of suction means 10 and 11 is therefore just one particularly convenient form of the invention.

While only a single embodiment of the present invention has been shown and described, it will be obvious that many changes and modifications may be made thereunto without departing from the spirit and scope of the invention.

What is claimed is:

1. A device for turning flat articles being conveyed along a conveying path, more particularly letter envelopes, flat bags or the like, said articles being turned in the flat condition about a vertical axis by 90°, said device comprising a first entraining member rotatable about a vertical axis, a second entraining member rotatable about a vertical axis offset from the axis of said first entraining member in the direction of article conveyance and overlapping said first entraining member to some extent, said first and second entraining members together turning the article being turned by 90°, and each entraining member having means for taking up and delivering the article being turned whereby one entraining member supports the article from above and the other entraining member supports the article from below.

2. The device according to claim 1, wherein the entraining members are provided with suction means disposed near one another.

3. The device according to claim 1, wherein said entraining members are turntables driven to the same hand and each having their periphery extending over the conveying path of the articles and wherein the working surface of one turntable is disposed above the plane defined by the direction of conveyance and the working surface of the other turntable is disposed below said plane.

4. The device according to claim 6, wherein said turntables are formed in their end faces which are near one another with at least one group each of associated suction orifices.

5. The device according to claim 4, which further comprises conveying and support means for said articles, said conveying and support means being disposed in the entry to and exit from the article turning device in the original direction of conveyance.

6. The device according to claim 5, wherein said conveying and support means are conveying rollers.

7. The device according to claim 5, wherein said conveying and support means are belt conveyors.

8. The device according to claim 5, wherein said conveying and support means comprises stationary segmental rolls driven at the cadence of the conveying machine disposed in the entry to and exit from the article turning device.

9. The device according to claim 1, wherein the means for the taking up and delivering said articles are grippers.

10. The device for turning flat articles being conveyed along a conveying path, more particularly letter envelopes, flat bags or the like, said articles being turned in the flat condition about a vertical axis by 90°, said device comprising:

(a) a first turntable for moving said articles out of said conveying path into a curvilinear path;

(b) a second turntable for moving said articles out of said curvilinear path into a second curvilinear path, without stopping the articles in their original direction of conveyance, until said articles are advancing again along the conveying path, the axes of said first and second turntables being disposed alongside said conveying path and offset with respect to each other so that said turntables overlap one another to some extent, said first and second turntables together turning the article being turned by 90°; and (c) each turntable being provided with means for taking up and delivering the article being turned.

* * * * *